US005142188A

United States Patent [19]

Ravi et al.

[11] Patent Number: 5,142,188

[45] Date of Patent: Aug. 25, 1992

[54] HIGH PRESSURE DISCHARGE LAMP UTILIZING AN UNSATURATED TYPE DISCHARGE TUBE

[75] Inventors: Jagannathan Ravi, Elmira, N.Y.; Kris Aelterman, Hoboken, Belgium

[73] Assignee: North American Philips Corporation, New York, N.Y.

[21] Appl. No.: 685,382

[22] Filed: Apr. 15, 1991

Related U.S. Application Data

[63] Continuation of Ser. No. 455,729, Dec. 21, 1989, abandoned.

[51] Int. Cl.[5] ..... H01J 17/20; H01J 61/12; H01J 61/20

[52] U.S. Cl. ..... 313/3; 313/25; 313/570; 313/571; 313/638; 313/639

[58] Field of Search ..... 313/3, 25, 570, 571, 313/638, 639; 315/178

[56] References Cited

U.S. PATENT DOCUMENTS

| | | | |
|---|---|---|---|
| 2,019,633 | 8/1933 | Rentschler | 313/25 |
| 2,026,941 | 8/1933 | Henry | 313/25 |
| 4,075,530 | 2/1978 | Furukubo | 313/625 |
| 4,751,432 | 6/1988 | Van Delm | 315/178 |
| 4,755,721 | 7/1988 | Okada et al. | 313/639 |

FOREIGN PATENT DOCUMENTS 1332852 10/1973 United Kingdom .

*Primary Examiner*—Donald J. Yusko
*Assistant Examiner*—N. D. Patel
*Attorney, Agent, or Firm*—William Squire

[57] ABSTRACT

Two series connected high pressure sodium arc discharge tubes include a saturated arc tube and an unsaturated arc tube. When the saturated arc tube voltage shifts in value due to changes in operating conditions, the other unsaturated arc tube voltage does not shift to compensate for the voltage increase. Because the unsaturated arc tube voltage does not shift, the rate of voltage shift of the saturated arc tube is smaller in magnitude than otherwise would occur if both arc tubes were saturated.

2 Claims, 1 Drawing Sheet

HIGH PRESSURE DISCHARGE LAMP UTILIZING AN UNSATURATED TYPE DISCHARGE TUBE

Figure 1:
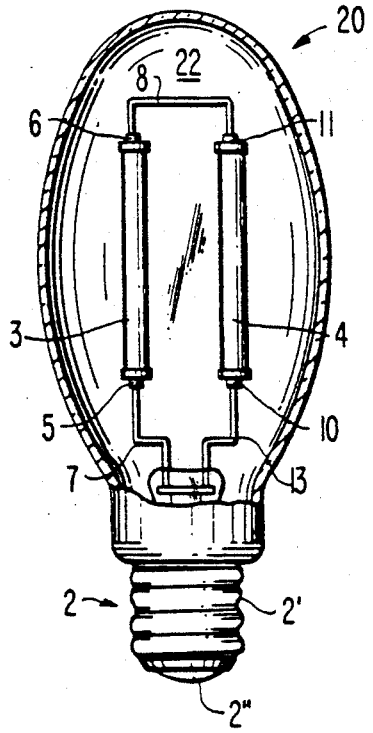

This is a continuation of application Ser. No. 455,739, filed Dec. 21, 1989, now abandoned.

This invention relates to a high pressure sodium discharge lamp construction employing series connected discharge tubes operating at high wattage.

Of interest is copending application Ser. No. 07/455,728 filed concurrently herewith, now U.S. Pat. No. 5,028,845 (case 3804-0332) entitled High Power High Wattage Series Arc Discharge Lamp Construction in the name of Aelterman et al. and U.S. Pat. No. 4,751,432 issued in the name of Van Delm, both of which are assigned to the assignee of the present invention.

High Power Series Discharge Lamps are described in the above-mentioned U.S. Pat. No. 4,751,432 and in British Patent Specification No. 1,332,852. In such lamps, two discharge tubes are connected in series and located within an evacuated outer bulb. The series connected arc tubes are employed to correct the color of the light emitted by the combined discharge lamps by using, for example, different types of discharge tubes in the series combination. Typically, a high voltage starting pulse is required to start high power lamps at high pressure. For example, a high pressure sodium discharge lamp contains a fill gas Xenin, of 10 kPa, typically. The typical high pressure sodium arc tube contains some tens of milligrams of sodium-mercury amalgam which is partially vaporized when the tube attains its operating temperature. The sodium content of the amalgam is about 20%. The non-vaporized amalgam collects in the coolest part of the discharge tube of a given lamp. However, other lamps may have the amalgam reservoir outside the discharge tube. By changing the color characteristics of each of the series connected discharge tubes, a more uniform or desirable color spectrum may be attained by the combination then otherwise would be possible from a single lamp.

For discharge tubes operating at relatively high power, for example, about 400 watts each, a relatively large starting voltage pulse is required, typically 1.5 to 5 kV. Once the lamps are ignited, they operate to produce a combined luminance output.

A problem recognized by the present inventors is that such sodium discharge lamps typically are of the saturated type. In a saturated lamp, liquid sodium-mercury amalgam is always present in the lamp structure. As a result, the lamp does not have constant lamp voltage characteristics such that the voltage will vary with a number of parameters during the life of the lamp. As the lamp ages, for example, its voltage may increase. Also, if a portion of the discharge tube blackens or deteriorates such that its light and heat transmission characteristics decreases, the voltage of the lamp will also increase.

In operating such a lamp, a ballast is used in combination with the lamp circuit to provide a stable lamp current. Such a ballast has parameters that are matched with the combined power of the two series connected discharge tubes such that for two 500 watt arc tubes connected in series the ballast is one which will be designed to operate with a 1000 watt lamp. In a high pressure sodium lamp operating in the saturated mode, the excess amalgam present in the discharge results in the lamp voltage increasing as the lamp wattage varies such that too high a lamp voltage causes the lamp to extinguish, and too low a lamp voltage results in a lamp not reaching its specified lamp output. The actual operating point of the given high pressure sodium lamp is influenced by electrical and non-electrical factors including the voltage level of the power supply, ballast characteristics and operating temperature. The influence of the voltage supply variations on both lamp voltage and lamp power is usually indicated by a lamp line curve. The present inventors recognize a problem with such series operated saturated high pressure, sodium discharge tubes in that such series connected tubes tend to prematurely fail. The reason for the failure is that when one saturated arc tube increases in voltage the other decreases due to the voltage-current characteristic of an arc discharge so that the increase in voltage in the one lamp eventually is significantly higher than normally expected by conventional knowledge.

A high pressure discharge lamp construction in accordance with the present invention comprises an outer bulb and first and second high pressure sodium discharge arc tubes within the outer bulb. Means are provided for electrically connecting the discharge tubes in series. At least one of the arc tubes has a sodium content such that the at least one arc tube operates in the unsaturated mode. An unsaturated arc tube operates at a constant voltage. When a saturated arc tube connected in series with the unsaturated arc tube shifts in voltage as that lamp ages, the voltage level of the unsaturated arc tube tends to remain constant.

Therefore, the voltage of the saturated arc tube, when subjected to conditions tending to cause the voltage to increase, will increase a magnitude significantly less than might otherwise occur if both tubes were saturated.

IN THE DRAWING

Figure 2:
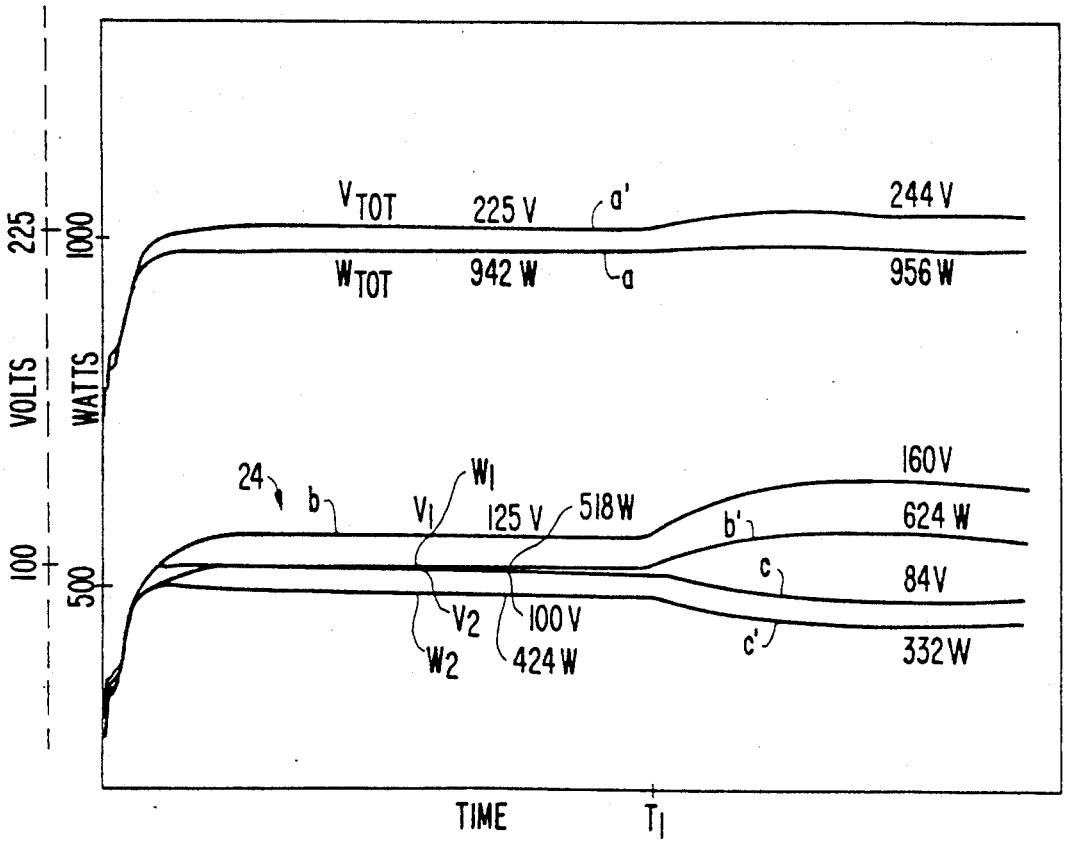

FIG. 1 is a sectional side elevation view of a series high pressure sodium discharge lamp in accordance with one embodiment of the present invention; and FIG. 2 is a chart of waveforms useful for explaining certain principles of the present invention.

In FIG. 1, a high pressure sodium discharge lamp construction 20 comprises an outer bulb 1 to which is secured a lamp cap 2. The cap 2 includes contacts 2' and 2'' and forms a seal with bulb 1 which encloses an evacuated chamber 22. Positioned within the chamber 22 are two high pressure sodium arc tubes 3 and 4. Each arc discharge tube is made of polycrystalline densely sintered translucent wall of aluminum oxide. Each arc tube 3 and 4 is constructed to operate at a typical operating power level of 500 watts but may operate at other levels. Tube 3 is unsaturated whereas tube 4 is saturated. Tube 4 being saturated contains some tens of milligrams of sodium-mercury amalgam which is partially vaporized when the tube reaches its operating temperature. The sodium content of the amalgam is about 20%. The non-vaporized amalgam collects in the coolest part of the discharge tube.

Arc tube 3 is unsaturated such that the discharge takes place in unsaturated vapor. An example of such a lamp is shown in U.S. Pat. No. 4,075,530. In this lamp, the sodium and mercury are always present in vapor form. An unsaturated high pressure sodium lamp is to be differentiated from a saturated lamp in that the unsaturated lamp exhibits a relatively constant lamp voltage during the life of the lamp. In comparison, in a high pressure saturated sodium lamp, the sodium and mercury are always present in both vapor and liquid form. As a result, the vapor pressure is significantly influenced by the temperature of the lamp. If, for example, the power dissipated in the lamp increases, this causes a temperature increase and thus the vapor pressure in the lamp will also rise. As consequence, the lamp voltage will also increase. The significance of this will be explained shortly.

A pair of niobium feed-throughs 5 and 6 are coupled to opposite ends of the tube 3. A current conducting wire 7 is connected at one end to niobium feed-through 5 and at the other end to cap contact 2''. A bent electrical conductor wire 8 is connected at one end to the niobium feed-through 6. The other discharge tube 4 has a pair of niobium electrical conductive feed-throughs 10 and 11 one at each of opposite ends thereof. An electrical conductor wire 13 is connected at one end to feed-through 10 and at the other end to a cap contact 2'. The other end of wire 8 is connected to niobium feed-through 11 to provide a series connection of wire 13 to wire 7 with the arc tubes 3 and 4 serially connected therebetween. The contacts 2' and 2'' are positioned to be connected to a mating socket (not shown) to which the lamp construction 20 is to be secured. The wires 7 and 13 provide structural support for the respective lamps 3 and 4. The combined arc tubes may be started with or without a bimetal bypass switch as shown, for example, in U.S. Pat. No. 4,751,432. The starting pulse is typically around 2 to 5 kV. The ballast (not shown) is designed to operate at 1000 watt dissipation of power to provide stabilization current to the two tubes 3 and 4 of the lamp construction 20.

In FIG. 2, curve a represents a plot of the operating characteristics of a series connected dual arc tube construction of the type described in the aforementioned U.S. Pat. No. 4,751,432 in which the discharge tubes 3 and 4 are operated in the saturated mode. The two saturated arc tubes operated in series operate at 942 watts combined. The two arc tubes exhibit a 225 voltage thereacross, curve a'. Assume at time $T_1$ that one of the arc tubes goes up in voltage as a result of blackening of the end of the tube due to reflective heat or goes up in voltage due to other causes (in this case simulated by shining a projector lamp on one end of one arc tube). Curves a and a' show that there is a relatively small observable change in the overall dissipated power and operating voltage of the two arc tubes in series as a combined unit. This change ordinarily does not appear significant. The dissipating wattage increases from 942 to 956 watts while the voltage across the two tubes increases from 225 to 244 volts. However, curves a and a' which typically are observed by one of ordinary skill in the art in evaluating such a series lamp combination does not tell the true story about the operating condition of the two arc tubes. The curves a and a' do not appear to indicate a significant problem is present which may cause premature failure of one of the arc tubes and hence the entire lamp.

Curves 24, FIG. 2, illustrate the plot of the particular voltage drops and power dissipated by each of the discharge tubes in the series lamp arrangement corresponding to the tubes depicted by curves a and a'. Curves b and b' illustrate respective voltage and power dissipation of one of the discharge tubes and curves c and c' illustrate respectively the voltage and power dissipation of a second of the tubes. Curve b shows that during the typical operating time prior to time $T_1$ one tube exhibits an operating voltage of 125 volts. When the temperature of that tube is increased, curve b shows that the operating voltage of that tube increases to 160 volts after time $T_1$. The same tube exhibits an operating power of 518 watts prior to time $T_1$ which, after time $T_1$ increases to 624 watts, curve b'. However, surprisingly, the operating 100 volts of the second tube in the typical operating period decreases to 84 volts, curve c. The operating power which during the typical operating period is 424 watts, drops to 352 watts, curve c'.

The reasons for these differences in the voltages and power of the two different discharge tubes is that the one discharge tube represented by curves b and b', increases to a higher voltage because of its saturated mode. The voltage thereof increases significantly above its rated voltage. In contrast, the voltage of the second tube illustrated by curve c drops to a significantly lower voltage at 84 volts. The reason for this is that the stabilization ballast tends to provide a near constant current to the combined discharge tubes in combination with the voltage-current characteristic typical for arc discharges. Therefore, as the voltage of one of the arc tubes increases the voltage of the other arc tubes decreases. Consequently, the voltage of one of the lamps increases significantly above its operating level, for example, to 160 volts, which is compensated for by the significant drop in voltage of the other arc tube curve c at 84 volts. Curve c produced by the other discharge tube drops in voltage due to the fact that that lamp operates in a saturated mode and its voltage shifts.

By operating one of the arc tubes in the unsaturated mode, the voltage of that one arc tube remains constant even though the voltage of the other arc tube, which may be saturated, increases. The rate of voltage increase of the saturated arc tube is significantly below the rate of increase in voltage of that arc tube when used in connection with a second saturated arc tube. Therefore, there is a significant drop in the voltage increase and power dissipation increase in the saturated arc tube when used in conjunction with an unsaturated arc tube at a given power operating level. In other words, the compensation mechanism operates to cause premature failure of the one discharge tube which burns at higher power. The compensation phenomena is controlled by making at least one of the discharge tubes unsaturated. In this case, when the saturated arc tube shows a voltage increase, there is no corresponding drop in the voltage of the other arc tube. The overall lamp voltage and power for the combined series lamp thus move up in the ballast curve as for a single arc tube of a standard high pressure sodium lamp. But because there is no compensatory decrease in voltage in the other arc tube, the conditions causing the one arc tube to exhibit increased power dissipation progressively results in a lower voltage increase in that arc tube and, therefore, the lamp life is not cut short prematurely. While there is a drop of voltage in the unsaturated arc tube over its life causing an increase in the loading of the other arc tube, this effect occurs far more slowly and hence is not believed serious.

In an alternate embodiment both arc tubes are unsaturated such that the overall lamp voltage does not increase under any circumstances. The voltage and power sharing between the two arc lamps remains controlled throughout the life of the lamp construction.

We claim:

1. A high pressure discharge lamp construction comprising:

an outer bulb;

first and second high pressure sodium discharge tubes within the outer bulb; and means for electrically connecting the discharge tubes in series, one of said arc tubes having a sodium and mercury content such that the one arc tube operates in the unsaturated mode, the other of said arc tubes having a sufficient sodium and mercury content to operate in the saturated mode.

2. The construction of claim 1 wherein the first and second arc tubes are arranged side-by-side in spaced relationship.

* * * * *